US007028349B2

(12) United States Patent
Helmetsie et al.

(10) Patent No.: US 7,028,349 B2
(45) Date of Patent: Apr. 18, 2006

(54) SHOWER SURROUND STRUCTURE

(75) Inventors: Eugene A. Helmetsie, Spencer, NY (US); Harper F. Zarker, Jr., Lumberton, NJ (US); Tomasz Pracel, Spencer, NY (US)

(73) Assignee: American Shower & Bath Corporation, Moorestown, NJ (US)

( * ) Notice: Subject to any disclaimer, the term of this patent is extended or adjusted under 35 U.S.C. 154(b) by 187 days.

(21) Appl. No.: 10/693,616

(22) Filed: Oct. 24, 2003

(65) Prior Publication Data

US 2005/0086736 A1 Apr. 28, 2005

(51) Int. Cl.
*A47K 3/022* (2006.01)

(52) U.S. Cl. ..... 4/596; 4/600; 4/612; 4/614

(58) Field of Classification Search ..... 4/596, 4/600, 612–614; 52/282.2, 481.2, 79.4, 264, 52/265

See application file for complete search history.

(56) References Cited

U.S. PATENT DOCUMENTS 1,933,857 A * 11/1933 Jones ..... 4/614
2,648,409 A * 8/1953 Daugherty et al. ..... 52/264
4,993,201 A * 2/1991 Bunyard ..... 4/614
6,698,037 B1 * 3/2004 Lippe ..... 4/612

* cited by examiner

*Primary Examiner*—Khoa D. Huynh
(74) *Attorney, Agent, or Firm*—Carlson, Gaskey & Olds

(57) ABSTRACT

A molded shower surround includes a base portion which receives wall portions and a corner portion therebetween. The corner portion includes an upper lock tab and a lower lock tab adjacent an outer edge. An upper lock slot and a lower lock slot are located adjacent the inner edge of each wall portions which engage the corner portion. Each side of the corner portion includes a corner flange arranged substantially perpendicular to a corner planar surface. The corner flange and the molded slots when combined with the upper lock tab and the lower lock tab which respectively engage the upper lock slot and the lower lock slot, provide a watertight interlocking arrangement between the corner portion and the wall portions. In one assembly method, the corner portion and a wall portion are locked into a sub-assembly then this sub-assembly is lifted and slide onto to a second wall which may already be mounted to the base portion. In another assembly the corner and wall portion are assembled to the base portion such that the assembled shower assembly can be "slid" into a corner.

31 Claims, 6 Drawing Sheets

SHOWER SURROUND STRUCTURE

BACKGROUND OF THE INVENTION

The present invention relates to an interface between panels of a molded plastic shower surround and a method of assembly therefor.

Conventional modular tub/shower units often include a base portion at the bottom and two or more wall portions. The whole structure is mounted adjacent a wall or corner to form a waterproof surround. The fully enclosed waterproof structure is highly advantageous in that it prevents the escape of water into the wall structure despite the shower spraying water onto the surrounding walls.

One problem which arises with products of this type is that of an uncomplicated assembly which will form a suitable joint between the surround portions. Various styles of joint have been used, each of which provide particular tradeoffs in complexity, aesthetics, and sealing ability.

Accordingly, it is desirable to provide a waterproof assembly interface between wall portions of a molded plastic shower surround which is uncomplicated and aesthetically pleasing while assuring an effective watertight seal.

SUMMARY OF THE INVENTION

The molded shower surround according to the present invention includes a base portion which receives wall portions and a corner portion therebetween. The base portion is located in a corner between two walls. The wall portions are located upon a ledge defined by the base portion. A corner slot is located within the ledge to receive a corner tab which extends from a lower end of the corner portion.

The corner portion includes an upper lock tab and a lower lock tab adjacent the outer edges. An upper lock slot and a lower lock slot are located adjacent the inner edge of each wall portion which engage the corner portion. Each side of the corner portion includes a corner flange arranged substantially perpendicular to a corner planar surface. Each of the corner planar surfaces are substantially parallel to the wall portions when in a mounted position. The corner flange is received within a molded slot which extends along the vertical length of the wall portion to provide an aesthetically pleasing interface. The corner flange and the molded slots when combined with the upper lock tab and the lower lock tab, which respectively engage the upper lock slot and the lower lock slot, provide a watertight interlocking arrangement between the corner portion and the wall portions.

In one assembly method, the base portion is positioned. The wall portions are then assembled to the corner portion. The three connected sections are then fitted to the base portion such that the corner portion is aligned such that the corner flanges are located within the molded slots. The corner portion is then slid downward until the corner tab enters the corner slot and the portions are locked to the base portion.

In another assembly method the base portion is initially not position or fastened to the wall. The corner and wall portions are assembled to the base portion such that the assembled shower assembly can be "slid" into the corner.

The present invention therefore provides a waterproof assembly interface between wall portions of a molded plastic shower surround which is uncomplicated and aesthetically pleasing while assuring an effective watertight seal.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
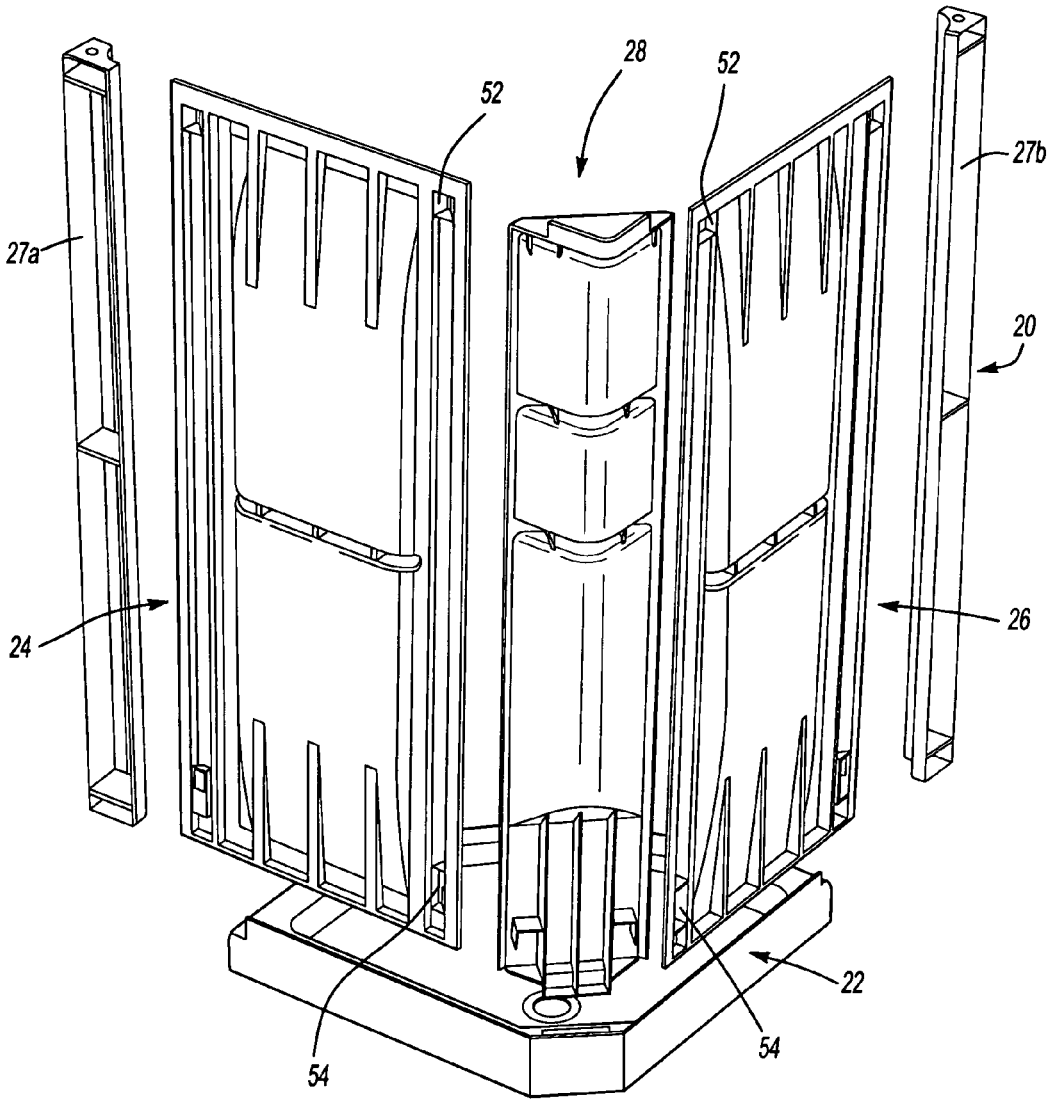
FIG. 1 is a general exploded rear view a molded shower surround according to the present invention.

FIG. 1 illustrates a general exploded view of a molded shower surround 20 which is formed of four pieces of molded plastic. A base portion 22 receives wall portions 24 and 26, a corner portion 28 therebetween, and an edge trim portion 27*a*, 27*b*. It should be understood that any number of wall portions will benefit from the present invention and that although a particular component arrangement is disclosed in the illustrated embodiment, other arrangements will benefit from the instant invention.

Figure 2:
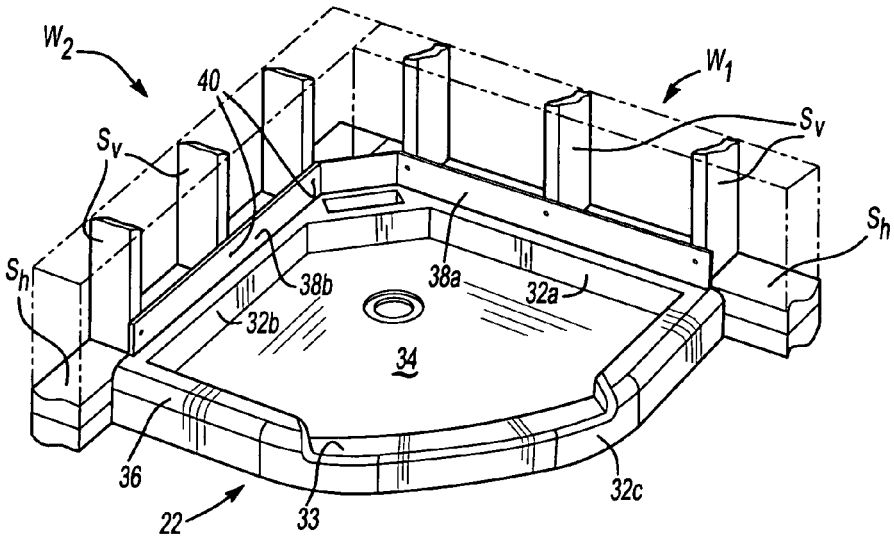
FIG. 2 is an expanded view of a base portion mounted adjacent a corner between two walls.

Referring to FIG. 2, the base portion is preferably located in a corner between two walls W1 and W2 which typically include a multiple of vertical wooden studs Sv and horizontal studs Sh. The base portion 22 fits adjacent the horizontal studs Sh. It should be understood that the wooden studs Sv, Sh are typically two-by-fours or the like usual for wall framing.

The base portion 22 defines a floor 34 bounded by a raised ledge 36. The ledge 36 of the base portion 22 preferably includes a first side 32*a* located perpendicular to a second side 32*b*. The hypotenuse side 32*c* of the base portion is preferably arcuate and includes a relief 33 in which a shower door (not shown) is located. A base periphery flange 38*a*, 38*b* preferably extend from the sides 32*a*, 32*b* to receive fasteners 40 such as nails which pass through the flanges 38*a*, 38*b* and into the vertical wooden studs Sv.

Figure 3:
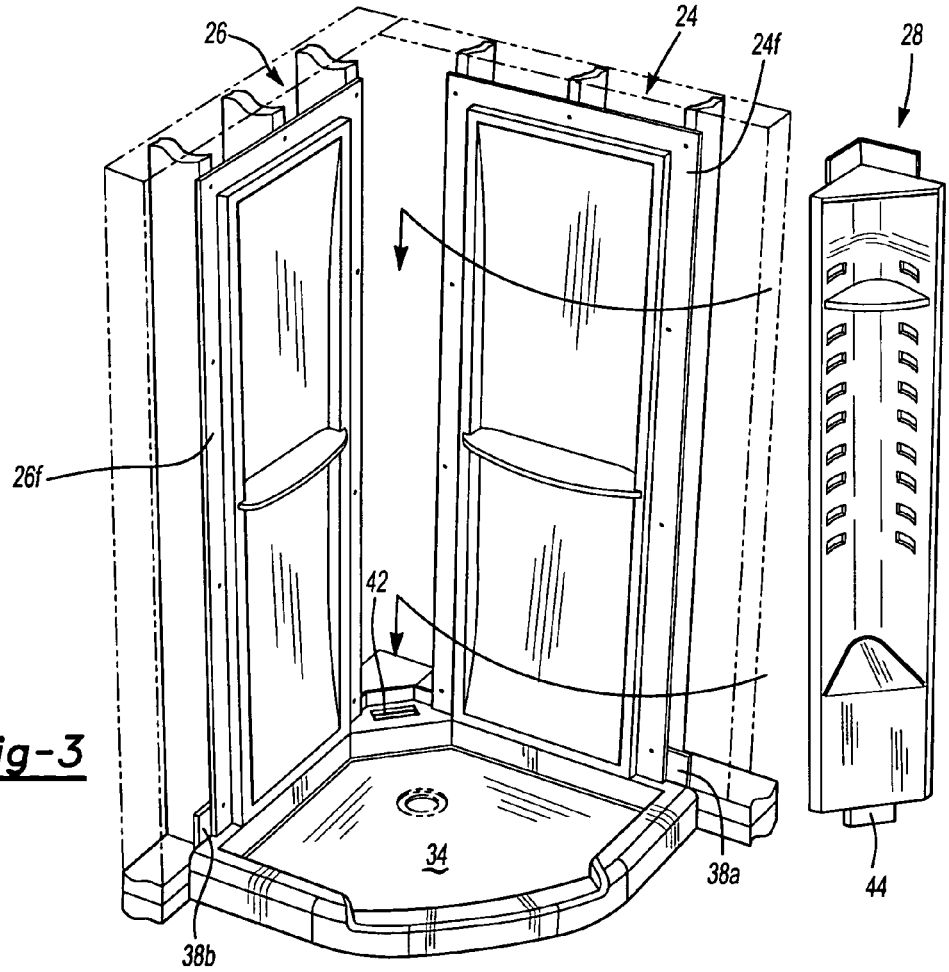
FIG. 3 is an exploded front view a molded shower surround showing assembly of wall and corner portions to the base portion of FIG. 2.

Referring to FIG. 3, the wall portions 24, 26 are located upon the ledge 36 on sides 32*a*, 32. The wall portions 24, 26 include periphery wall flanges 24*f*, 26*f* which receive fasteners 40 such as nails which pass through the wall flanges 24*f*, 26*f* and into the vertical wooden studs Sv. Preferably, the flanges 24*f*, 26*f* are located inside the flanges 38*a*, 38*b*.

That is, the wall flanges 24*f*, 26*f* are in from of the flanges 38*a*, 38*b* relative the floor 34.

Figure 4:
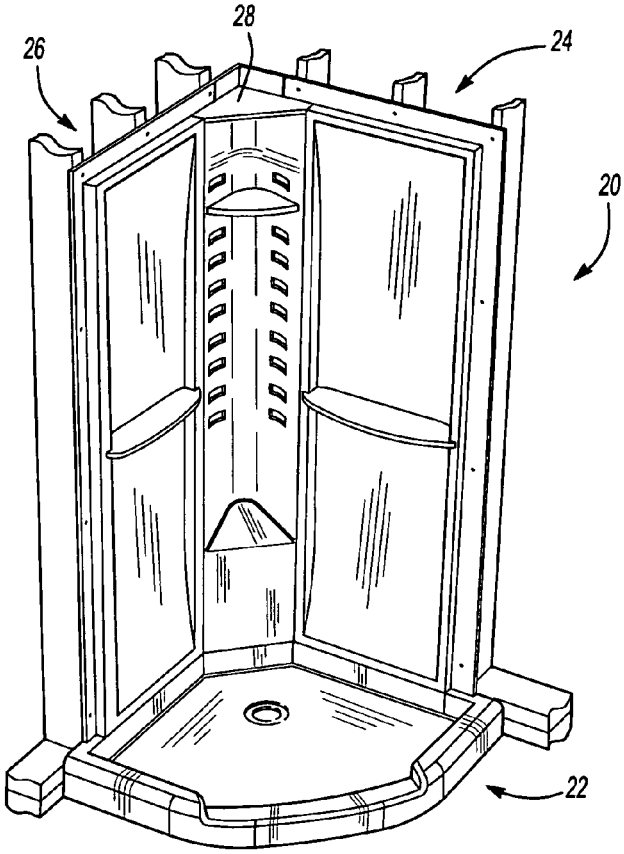
FIG. 4 is an front perspective view a molded shower surround in an assembled condition.

A corner slot 42 is located within the ledge 36 where the sides 32*a*, 32*b* meet. A corner tab 44 which extends from a lower end of the corner portion 28 fits into the corner slot 42 (FIG. 5) to provide a waterproof join between the walls 24, 26 (FIG. 4).

Figure 5:
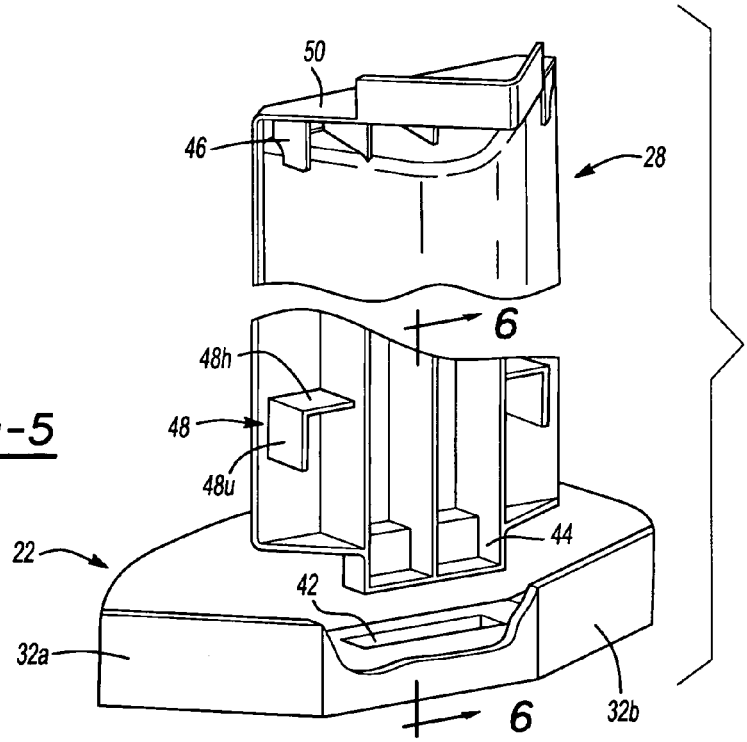
FIG. 5 is an expanded rear view of a corner portion adjacent a base portion.

Referring to FIG. 5, the corner portion 28 includes an upper lock tab 46 and a lower lock tab 48. The upper lock tab 46 extends from a horizontal top 50 of the corner portion 28. That is, the upper lock tab 46 is generally vertical. The lower lock tab 48 is preferably L-shaped having a horizontal portion 48*h* and a vertical portion 48*v*.

Figure 6:
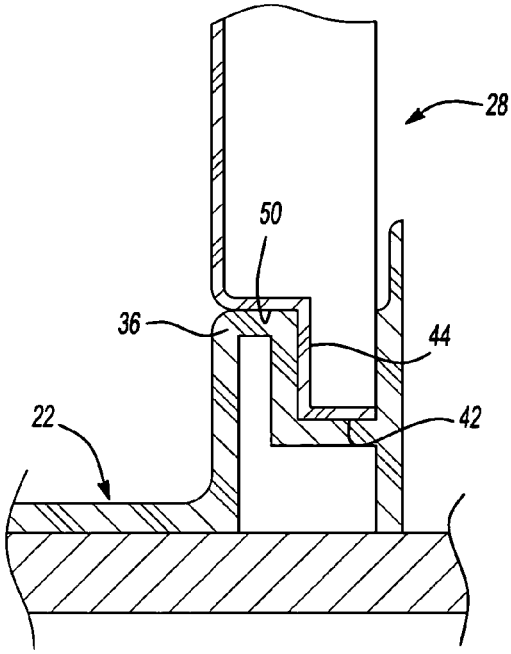
FIG. 6 is a sectional view of the corner portion mounted to the base portion taken along the line 6—6 in FIG. 5.

Referring to FIG. 6, the corner tab 44 preferably includes a step shape having a horizontal flat 50 which mates atop the ledge 36. The corner tab 44 thereby engages the corner portion 28 with the base portion 22.

Figure 7:
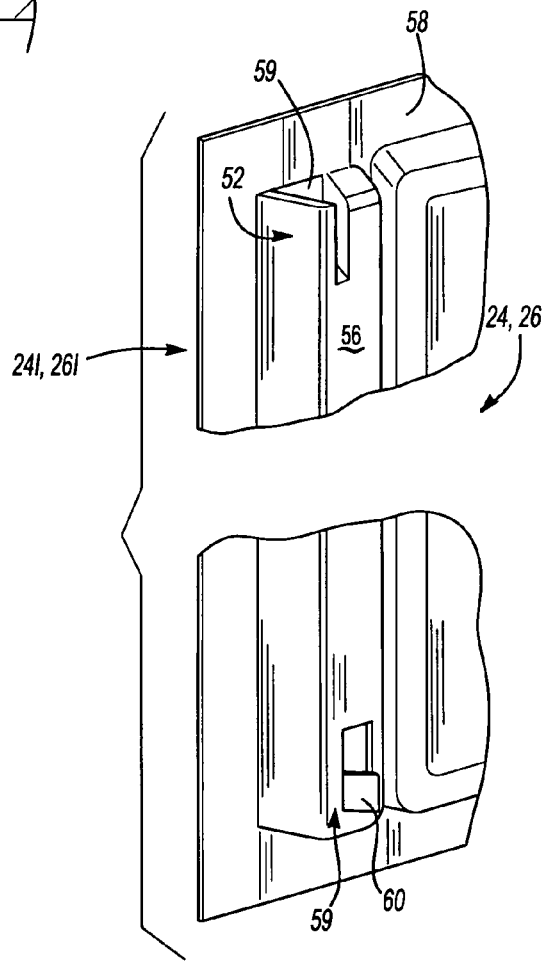
FIG. 7 is an expanded view of an inner edge of a wall portion which engages a corner portion of the shower surround.

Referring to FIG. 7, an upper lock slot 52 and a lower lock slot 54 are located adjacent the inner edge 24I and 26I of each wall portions 24, 26 (also illustrated in FIG. 1). The inner edge is herein defined as the edge of the wall portions 24, 26 which engage the corner portion 28. The upper lock slot 52 and the lower lock slot 54 will not be visible upon installation of the corner portion 28.

Figure 8:
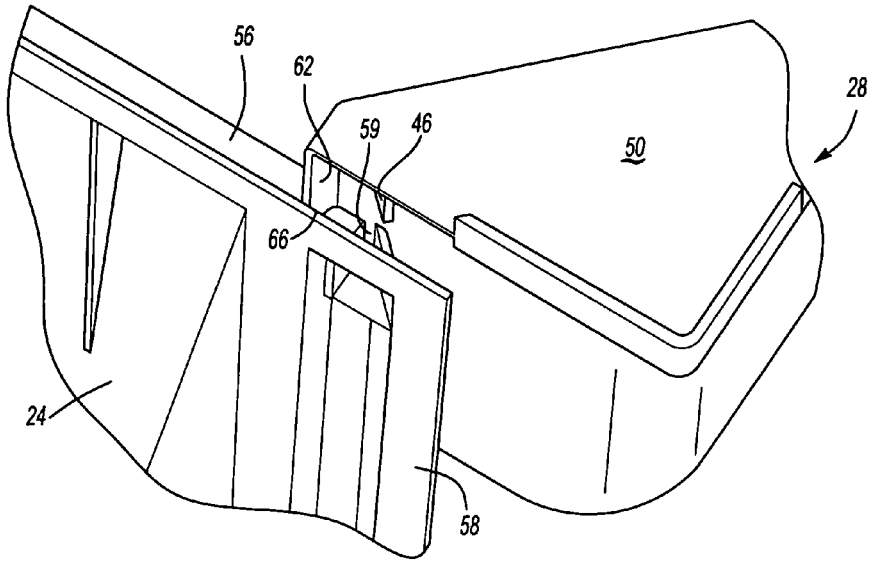
FIG. 8 is exploded view of a lock slot in an inner edge of a wall portion which engages a corner portion of the shower surround.

The upper lock slot 52 is located within a raised area 56 which extends from a planar portion 58 of each wall portion 24, 26. The planar portion 58 generally includes the flange 24*f*, 26*f*. The raised area 56 extends toward the interior of the shower surround 20 (FIG. 4). The raised area 56, at least in part, is preferably of an aesthetically pleasing appearance of various designs and shapes and may alternatively or additionally include functional features such as shelves or the like. The upper lock slot 52 preferably defines an angular opening which includes an open end 59 which extends through the top of the raised area 56 to receive the upper lock tab 46 (FIG. 8). The upper lock tab 46 and the upper lock slot 52 are preferably arranged to be generally parallel to an axis A which bisects an angle formed between the wall portions 24, 26 (FIG. 9).

The lower lock slot 54 includes a lock slot tab 60 which extends inward of the raised area 56. That is, the upper lock slot tab 60 extends toward the interior of the shower surround 20 to engage the vertical portion 48*v* of the lower lock tab 48 (FIG. 4).

Figure 9:
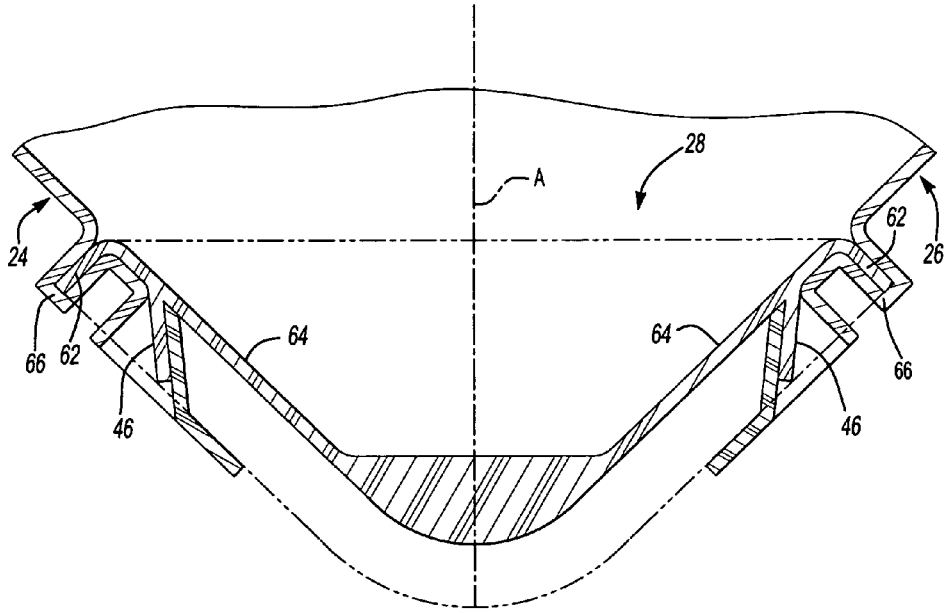
FIG. 9 is top partial sectional view of the corner portion interface with the wall portions.

Referring to FIG. 9, each side of the corner portion 28 includes a corner flange 62 arranged substantially perpendicular to a corner planar surface 64. The corner flanges 62 are located along the outer vertical ends of the corner portion 28 to provide an interface with the wall portions 24, 26. Each of the corner planar surfaces 64 are substantially parallel to the wall portions 24, 26 when in a mounted position. The corner flange 62 is received within a molded slot 66 which extend along the vertical length of the wall portion 24, 26 to provide an aesthetically pleasing and waterproof interface.

The corner flange 62 and the molded slot 66, when combined with the upper lock tab 46 and the lower lock tab 48 (FIG. 5) which respectively engage the upper lock slot 52 and the lower lock slot 54, provide a watertight interlocking arrangement between the corner portion 28 and the wall portions 24, 26.

Figure 10:
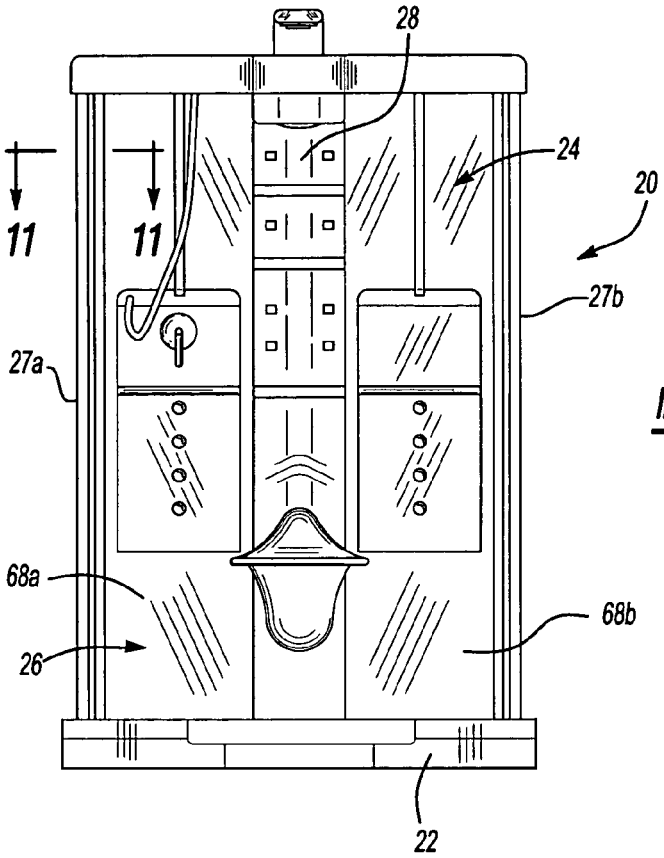
FIG. 10 is a front view a molded shower surround according to the present invention.
Figure 11:
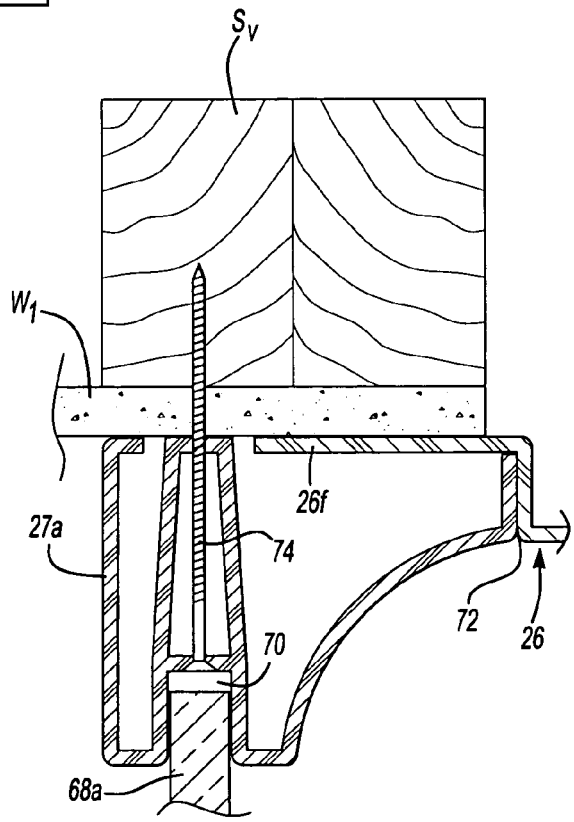
FIG. 11 is a sectional view of an end trim portion taken along line 10—10 in FIG. 10.

Referring to FIG. 10, each edge trim portion 27*a*, 27*b* mounts respectively to the wall portions 24, 26 to secure the edges to a vertical stud Sv (FIG. 11). The edge trim portions 27*a*, 27*b* support a glass enclosure 68 including side glass panels 68*a*, 68*b*.

Referring to FIG. 11, each edge trim portion 27*a*, 27*b* includes a glass groove 70 to receive the side glass panel 68*a*. It should be understood that although only each edge trim portion 27*a* is illustrated in FIG. 11, edge trim portion 27*b* is constructed in a likewise manner. Edge trim portion 27*a* overlays the wall periphery flanges 26*f* and preferably mates with the wall portion 26 at vertical interface 72. Vertical interface 72 prevents a buildup of water therebetween due to water being able to drain vertically downward.

Preferably, glass groove 70 includes an aperture to receive a fastener 74 such as a screw. The fastener 74 passes through the glass groove 70 and engages into the wall W1 and vertical stud Sv. The fastener 74 is enclosed by the side glass panel 68*a* which fits into the glass groove 70 preferably through a sealant-less joint. That is, the flexibility of the glass groove 70 provides for an interference fit with the side glass panel 68*a* which minimizes or eliminates the need for caulk.

In one assembly method, the base portion 22 is mounted to a wall of a structure. Preferably, the base portion 22 is located in a corner. The wall portions 24, 26 are then assembled to the corner portion 28. The three connected sections 24, 26, 28 are then fitted to the base portion 22 such that the corner portion 28 is aligned and the corner flanges are located within the molded slots. The corner portion 28 is then aligned such that the corner flanges 62 are located within the molded slots 66 and the portions 24, 26, 28 are locked to the base portion 22. Preferably, the corner portion and a wall portion 24, 26 is locked into a sub-assembly then this sub-assembly is lifted and slide onto to the second wall which may already be mounted to the base portion 22. Each edge trim portion 27*a*, 27*b* is then mounted to the wall portions 24, 26 and the glass enclosure 68 without the need for caulk.

In another assembly method the base portion 22 is initially not position or fastened to the structure such as a corner or wall. The corner portion 28 and wall portions 24, 26 are assembled to the base portion 22 such that the assembled shower assembly can be "slid" into the corner.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A shower surround comprising:

a base portion which defines a corner slot formed on a top surface of said base portion;

a first wall portion;

a second wall portion; and a corner portion engaged with said base portion, said first wall portion and said second wall portion, said corner portion including a horizontal top, an opposite lower end and a corner tab extending downwardly from said opposite lower end and engaging with said corner slot, an upper lock tab and a lower lock tab extending from a side of said corner portion, wherein said upper lock tab located adjacent said horizontal top and said lower lock tab located adjacent said opposite lower end of said corner portion, wherein said upper lock tab extends downwardly and generally perpendicularly from said horizontal top of said corner portion.

2. The shower surround as recited in claim 1, wherein said corner tab is receivable within said corner slot.

3. The shower surround as recited in claim 1, wherein said lower lock tab comprises a generally L-shape with a horizontal portion generally parallel to said base portion.

4. The shower surround as recited in claim 1, further comprising an upper lock slot and a lower lock slot located adjacent an inner edge of each of said first and second wall portions, said upper lock slot and said lower lock slot respectively receiving said upper lock tab and said lower lock tab.

5. The shower surround as recited in claim 1, further comprising a corner flange extending from each outer edge of said corner portion said corner flange extends substantially perpendicular to a corner planar surface.

6. The shower surround as recited in claim 5, wherein said an upper lock tab extends from said corner planar surface, said upper lock tab defining an obtuse angle relative said corner flange.

7. The shower surround as recited in claim 6, wherein said upper lock lab is arranged generally parallel to an axis which bisects an angle formed between the first and second wall portions.

8. The shower surround as recited in claim 5, further comprising a slot extending along said first and said second wall portions, each said corner flanges respectively engageable with said slots.

9. The shower surround as recited in claim 8, wherein said slot extends vertically along said first and said second wall portions for the lengths of said first and second wall portions.

10. The shower surround as recited in claim 1, wherein said base portion, said first wall portion and said second wall portion each comprise a flange extending at least partially around a periphery thereof.

11. The shower surround as recited in claim 1, further comprising an edge trim portion comprising a glass groove.

12. The shower surround as recited in claim 11, further comprising a fastener opening within said glass groove.

13. The shower surround as recited in claim 1, further comprising an edge trim portion which at least partially overlays a flange extending at least partially around a periphery of said first wall portion.

14. The shower surround as recited in claim 1, wherein said corner slot is located within a raised ledge defined about a floor of said base portion.

15. A shower surround comprising:

a base portion comprising a corner slot formed on a top surface of said base portion;

a first wall portion adjacent said base portion, said first wall portion comprising an upper lock slot and a lower lock slot located adjacent an inner edge of said first wall portion;

a second wall portion adjacent said base portion said second wall portion comprising an upper lock slot and a lower lock slot located adjacent an inner edge of said second wall portion; and a corner portion comprising a corner tab engaged within said corner slot, upper lock tabs and lower lock tabs adjacent a first and a second corner flanges of said corner portion, said upper lock tabs engaging with said upper lock slots and said lower lock tabs engaging said lower lock slots of said first wall portion and said second wall portion.

16. The shower surround as recited in claim 15, wherein said first and said second corner flanges extending respectively from said corner portion.

17. The shower surround as recited in claim 16, further comprising a first slot extending along said first wall portion and a second slot along said second wall portion, said first and said second corner flange respectively engageable with said first and said second slot.

18. The shower surround as recited in claim 17, wherein said first and said second slot extends vertically along said first and said second wall portion.

19. The shower surround as recited in claim 15, wherein one of said upper lock tabs defining an obtuse angle relative said corner flange.

20. The shower surround as recited in claim 15, wherein said corner flanges arranged substantially perpendicular to a coiner planar surfaces, one said upper lock tabs extending from said corner planar surfaces.

21. The shower surround as recited in claim 20, wherein each of said upper lock tabs is arranged generally parallel to an axis which bisects an angle formed between the first and second wall portions.

22. The shower surround as recited in claim 21 wherein each of said upper lock slots is defined within a raised area which extends from a planar wall portion of said first wall portion, said each of said upper lock slots defines an angular opening having an open end to receive each of said upper lock slots such that said corner flanges abuts said raised area.

23. The shower surround as recited in claim 20, wherein each of said upper lock tab defines an obtuse angle relative one of said corner flanges.

24. The shower surround as recited in claim 23, wherein each of said upper lock slots is defined within a raised area which extends from a planar wall portion of said first wall portion, said each of said upper lock slots defines an angular opening having an open end to receive each of said upper lock slots such that said corner flanges abuts said raised area.

25. The shower surround as recited in claim 20, wherein each of said upper lock slots is defined within a raised area which extends from a planar wall portion of said first wall portion, said each of said upper lock slots defines an angular opening having an open end to receive each of said upper lock slots such that said corner flanges abuts said raised area.

26. A method of assembling a shower surround comprising the steps of:

(1) providing a corner portion including a horizontal top, an opposite lower end and a corner tab extending downwardly from said opposite lower end, an upper lock tab and a lower lock tab extending from a side of said corner portion, wherein said upper lock tab located adjacent said horizontal top and said lower lock tab located adjacent said opposite lower end of said corner portion, wherein said upper lock tab extends downwardly and generally perpendicularly from said horizontal top of said corner portion;

(2) assembling said corner portion to a first wall portion;

(3) assembling a second wall portion onto a base portion which defines a corner slot formed on a top surface of said base portion; and (4) assembling the assembled corner portion and the first wall portion from said step (2) to said base portion and the second wall portion such that the corner portion interlocks with the base portion and the second wall portion and said corner tab of the corner portion slides within said corner slot in a raised ledge defined about a floor of the base portion.

27. A method as recited in claim 26, further comprising the step of attaching said base portion to a plurality of wall studs.

28. A method as recited in claim 26, wherein said step (3) further comprises sliding a first corner flange and a second corner flange into a respective first slot in said first wall portion and a second slot in said second wall portion.

29. A method as recited in claim 26, further comprising the step of attaching an edge trim portion which at least partially overlays a flange extending at least partially around a periphery of said first wall portion.

30. A method as recited in claim 29, further comprising the step of fastening the edge trim portion to a wall stud with a fastener which passes through a glass groove defined by the edge trim portion.

31. A method as recited in claim 30, further comprising the step of enclosing the fastener with a glass panel interference fit into the glass groove.

* * * * *

UNITED STATES PATENT AND TRADEMARK OFFICE

CERTIFICATE OF CORRECTION

PATENT NO. : 7,028,349 B2
APPLICATION NO. : 10/693616
DATED : April 18, 2006
INVENTOR(S) : Eugene A. Helmetsie, Harper F. Zarker, Jr. and Tomasz Pracel It is certified that error appears in the above-identified patent and that said Letters Patent is hereby corrected as shown below:

Column 6:

Line 20: Please delete “coiner” and insert --corner--

Line 41: Please Delete “20” after “Claim” and insert --23--

Signed and Sealed this

Twenty-eighth Day of November, 2006

JON W. DUDAS
*Director of the United States Patent and Trademark Office*